US005187909A

United States Patent [19]

Olson

[11] Patent Number: 5,187,909

[45] Date of Patent: Feb. 23, 1993

[54] GLASS BLOCK WINDOW SYSTEM

[75] Inventor: Ronald H. Olson, Park Ridge, Ill.

[73] Assignee: Glashaus Incorporated, Arlington Heights, Ill.

[21] Appl. No.: 753,725

[22] Filed: Sep. 3, 1991

[51] Int. Cl.[5] ..... E06B 1/04; E04B 2/58

[52] U.S. Cl. ..... 52/308; 52/210; 52/213

[58] Field of Search ..... 52/306, 307, 308, 210, 52/215, 211, 213

[56] References Cited

U.S. PATENT DOCUMENTS 2,326,245 8/1943 Nichols et al. ..... 52/308

5,014,471 5/1991 Ballstadt ..... 52/308

OTHER PUBLICATIONS

Pittsburgh Corning Corporation:1986 PC Glass Block Products.

*Primary Examiner*—Michael Safavi

*Attorney, Agent, or Firm*—Wallenstein, Wagner & Hattis, Ltd.

[57] ABSTRACT

A glass block window system for installation in a gypsum board wall is disclosed. The window system comprises a wall opening defined by a window frame comprising a sill stud, a header stud and first and second jamb studs. A hollow metal frame defines a window opening. The frame includes frame members comprising a sill member, a header member, and first and second jamb members joining the sill member and the header member. A block channel comprising a sill channel, a header channel and first and second jamb channels is secured to the frame members. A plurality of contiguous glass blocks forming a window unit is secured within the block channel.

12 Claims, 3 Drawing Sheets

GLASS BLOCK WINDOW SYSTEM

DESCRIPTION

1. Technical Field

The present invention relates to glass block window systems and, more particularly, to a fire rated hollow metal frame for supporting a glass block window system within a wall made of metal studs and gypsum board.

2. Background Prior Art

In building construction, it is often desirable to have an internal wall having a window comprising a plurality of glass blocks. In some locations fire walls are required for exit pathways. In the past, to achieve a fire-rating, the wall had to be made of masonry, rather than the more typical gypsum board.

The present invention is provided to solve these and other problems.

SUMMARY OF THE INVENTION

It is an object of this invention to provide a fire-rated glass block window system for installation in a gypsum board wall assembly.

According to the invention, the system comprises an opening comprising a sill stud, a header stud and first and second jamb studs. The system further comprises a hollow metal frame defining a window opening. The frame includes frame members comprising a sill member, a header member, and first and second jamb members joining the sill member and the header member. The hollow metal frame is secured to the studs by a plurality of z-shaped anchors.

The system further includes a metal channel comprising a sill channel, a header channel and first and second jamb channels. The sill channel, header channel and first and second jamb channels are secured to respective ones of the frame members. A plurality of contiguous glass blocks form a window unit having a peripheral window surface secured within the metal channel.

A layer of mortar is disposed between the sill channel and the glass block, and a layer of glass fiber insulation is disposed between the jams and header channels and the glass block.

Other features and advantages of the invention will be apparent from the following specification taken in conjunction with the following drawing.

DETAILED DESCRIPTION

Figure 1:
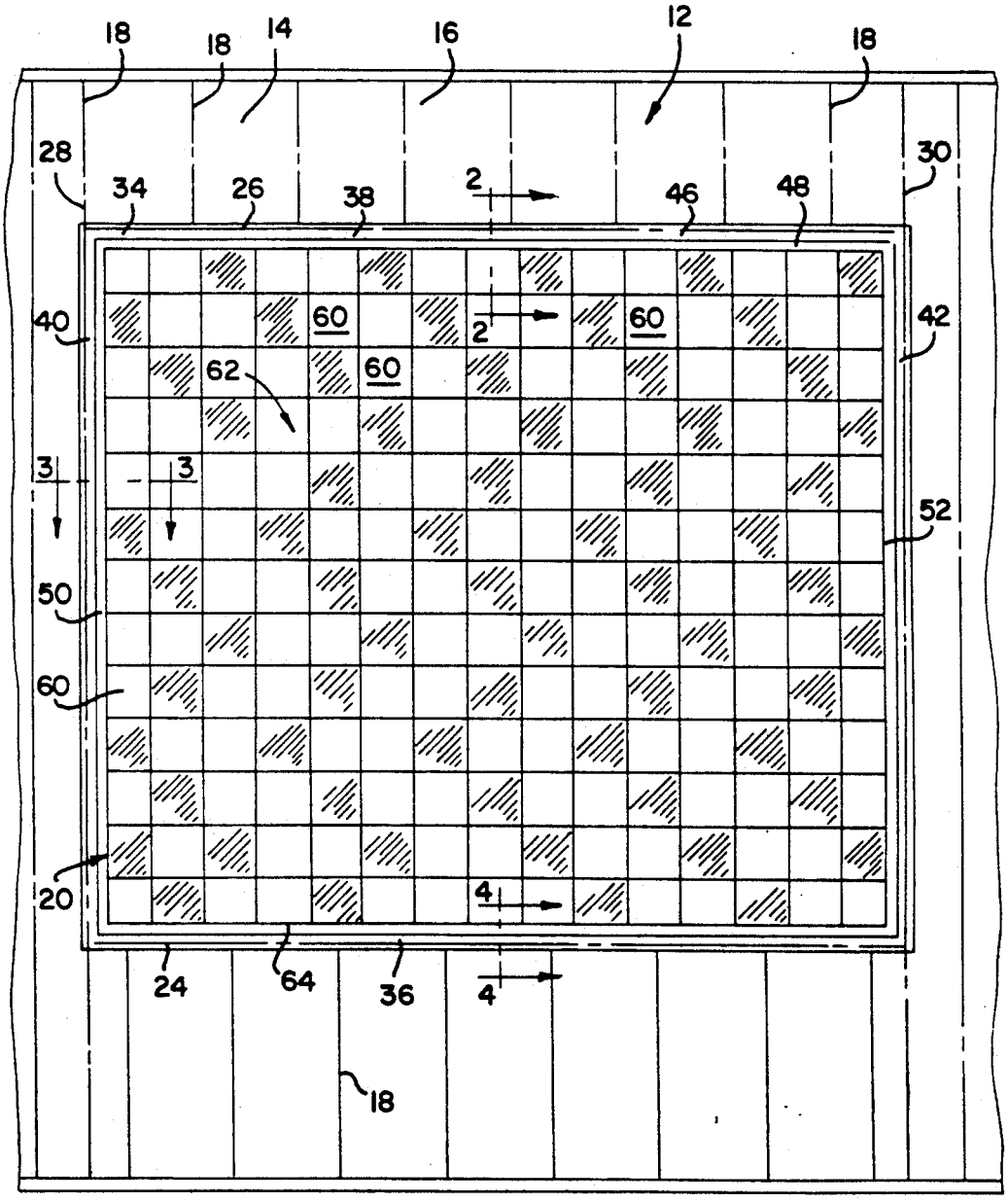
FIG. 1 is an elevational view of a glass block window system according to the present invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A glass block window system, generally designated 12, for installation in a gypsum board wall 14, is illustrated in FIG. 1. The gypsum board wall 14 is of standard construction, being formed of ⅝" fire-rated gypsum board 16 and ⅝"×20 and 25 gage metal studs 18. In addition, a wall opening 20 is cut from the gypsum board and framed by the metal studs 18 to form a window frame 22 comprising a sill stud 24, a header stud 26 and first and second jamb studs 28, 30, respectively. In the preferred embodiment, the sill stud 24 is formed of 20 gage material for added strength.

Figure 5:
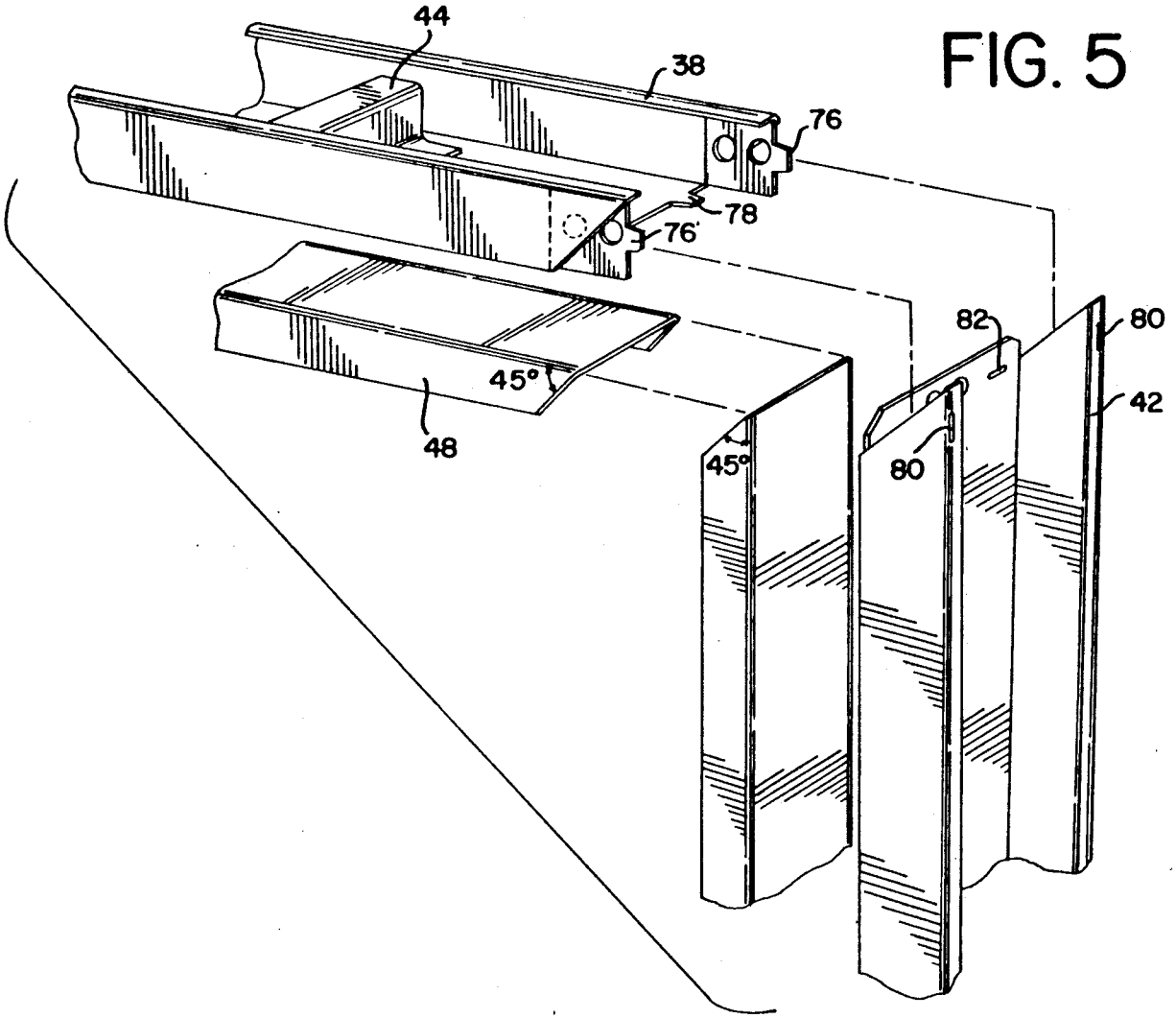
FIG. 5 is a perspective view of a hollow metal frame as utilized by the window system of FIG. 1.

A hollow metal frame 34 is disposed within the window opening 20. The frame 34 is made of 16 gage metal and includes frame members comprising a sill member 36, a header member 38, and opposing first and second jamb members 40, 42, respectively. The first and second jamb members 40, 42 extend between and join the sill member 36 and the header member 38. As discussed in greater detail below, the hollow metal frame 34 is secured to the to the window frame 22 by a plurality of spaced z-anchors 44 (FIG. 5). The z-shaped anchors 44 are spaced at 8" centers. They are welded to the hollow metal frame 34 and fastened by screws to the window frame 22.

A metal channel 46 is formed of 14 gage metal comprises a sill channel 48, a header channel 50 and first and second jamb channels 52, 54, respectively. The channels 48, 50, 52, 54 are secured to respective ones of the frame members by screws.

A plurality of contiguous glass blocks 60, such as an 8"×8"×3" glass block manufactured by Weck GmbH of Germany, and distributed in the United States by Glashaus, Inc., assignee of this application, forming a window unit 62. The window unit 62 has a peripheral window surface 64 secured within the metal channel 46.

Figure 2:
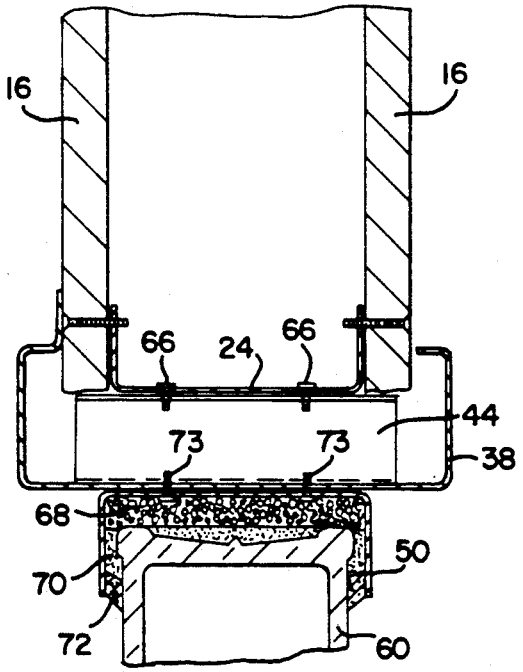
FIG. 2 is a section of the window system of FIG. 1, taken along lines 2—2 of FIG. 1.
Figure 4:
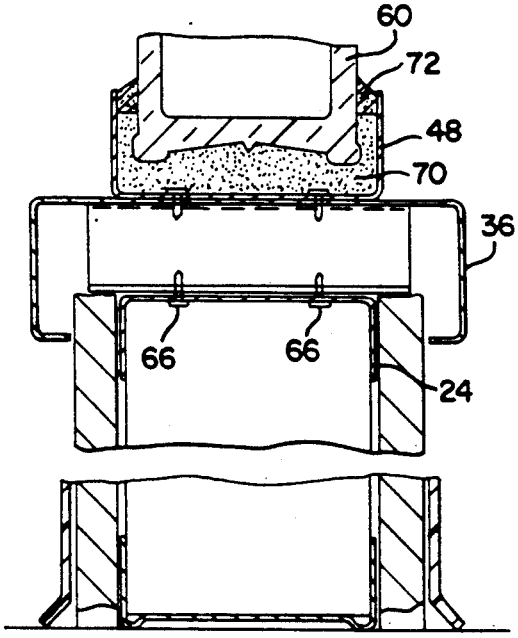
FIG. 4 is a section of the window system of FIG. 1, taken along lines 4—4 of FIG. 1.
Figure 3:
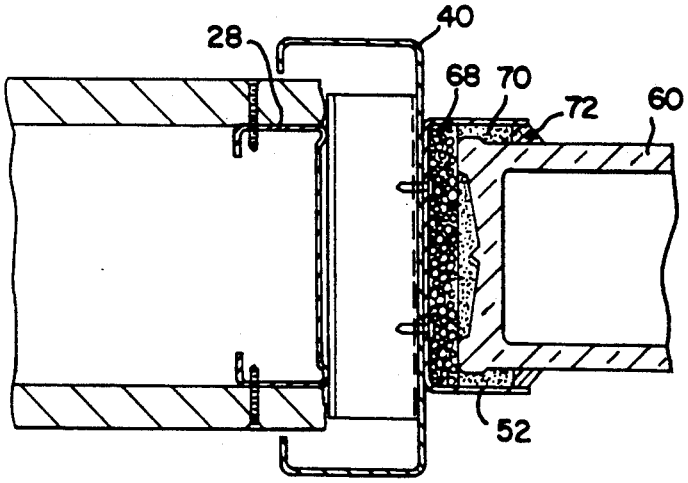
FIG. 3 is a section of the window system of FIG. 1, taken along lines 3—3 of FIG. 1.

The specific details of the construction is shown in FIGS. 2–4.

FIG. 2 is a section of the window system 12 showing the construction of the header.

As seen in cross section, the header member 38 is generally c-shaped. The header stud 26 is attached to each of the z-shaped anchors 44 along the header member 38 by pairs of screws 66 spaced at 16" centers. Positioned between the glass block 60 and the header channel 50 is a ½" layer of a compressible filler such as glass fiber insulation 68. Exterior to the glass fiber 68 is a bead of mortar 70 and a further bead of sealant 72, such as silicone. The compressible filler permits expansion and contraction of the window unit 62 within the metal channel, especially in times of high thermal stress, such as during a fire.

A series of pairs of screws 73, at 8" centers, secures the header channel 50 to the header member 38. Similarly, pairs of screws secure the other channels to their respective frame members.

FIG. 3 is a section of the window system 12 showing the construction of the jambs, which is substantially the same as the construction of header of FIG. 2.

FIG. 4 is a section of the window system 12 showing the construction of the sill. The construction of the sill is substantially the same as the construction of the header and the jambs, described above, except that rather than a layer of compressible filler 68, a complete layer of the mortar 70 is provided.

An exploded view of the joinder of two of the frame members is disclosed in FIG. 5. For purposes of illustration the upper frame member will be referred to as the header member 38, and the side frame member will be referred to as the second jamb member 42. The header member 38 includes a pair of outward tabs 76 and a pair of inward tabs 78 which are received by a respective pair of outward slots 80 and inward slots 82 on the jamb member 42. The outward tabs 76 are extensions of brackets 79 plug welded to the frame. The header channel 48 is secured to the header member 38 by spaced screws (not shown) positioned every eight inches. Similarly, the other channels are so coupled to their respective frame members.

A 10'0"×8'−8" nominal window system built according to the above specifically has successfully passed U.L. test UL9.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A glass block window system for installation in a gypsum board wall, said window system comprising:

a wall opening defined by a window frame comprising a sill stud, a header stud and first and second jamb studs;

a hollow metal frame defining a window opening, said frame including frame members comprising a sill member, a header member, and first and second jamb members joining said sill member and said header member;

means for securing said hollow metal frame to said window frame, wherein said means for securing said hollow metal frame to said window frame comprises a plurality of generally z-shaped anchors;

a metal channel comprising a sill channel, a header channel and first and second jamb channels, said sill channel, header channel and first and second jamb channels secured to respective ones of said sill member, first and second jamb members and header member; and a plurality of contiguous glass blocks forming a window unit, said window unit having a peripheral window surface secured within said metal channel.

2. The glass block window system of claim 1 wherein each of said z-shaped anchors are welded to said hollow metal frame and screwed to said window frame.

3. A glass block window system for installation in a gypsum board wall, said window system comprising:

a wall opening defined by a window frame comprising a sill stud, a header stud and first and second jamb studs;

a hollow metal frame defining a window opening, said frame comprising a sill member, a header member, and first and second jamb members joining said sill member and said header member;

a plurality of spaced, generally z-shaped anchors secured to said frame members and said studs for securing said hollow metal frame to said window frame;

a metal channel extending around the inner periphery of said window opening;

a plurality of contiguous glass blocks forming a window unit, said window unit having a peripheral window surface secured within said metal channel; and a layer of glass fiber insulation disposed between said metal channel and said window unit.

4. The glass block window system of claim 3 wherein said metal channel comprises a sill channel, a header channel and first and second jamb channels, said sill channel, header channel and first and second jamb channels secured to respective ones of said sill member, first and second jamb members and header member.

5. The metal channel of claim 4 including a layer of mortar disposed between said sill channel and said window unit.

6. The glass block window system of claim 3 wherein each of said z-shaped anchors are welded to said hollow metal frame and screwed to said window frame.

7. A glass block window system for installation in a gypsum board wall, said window system comprising:

a wall opening defined by a window frame comprising a sill stud, a header stud and first and second jamb studs;

a hollow metal frame defining a window opening, said frame including frame members comprising a sill member, a header member, and first and second jamb members joining said sill member and said header member;

means for securing said hollow metal frame to said window frame, wherein said means for securing said hollow metal frame to said window frame comprises a plurality of generally z-shaped anchors;

a channel comprising a sill channel, a header channel and first and second jamb channels, said sill channel, header channel and first and second jamb channels secured to respective ones of said sill member, first and second jamb members and header member; and a plurality of contiguous glass blocks forming a window unit, said window unit having a peripheral window surface secured within said channel.

8. The glass block window system of claim 7 wherein each of said z-shaped anchors are welded to said hollow metal frame and screwed to said window frame.

9. A glass block window system for installation in a gypsum board wall, said window system comprising:

a wall opening defined by a window frame comprising a sill stud, a header stud and first and second jamb studs;

a hollow metal frame defining a window opening, said frame comprising a sill member, a header member, and first and second jamb members joining said sill member and said header member;

a plurality of spaced, generally z-shaped anchors secured to said frame members and said studs for securing said hollow metal frame to said window frame;

a channel extending around the inner periphery of said window opening;

a plurality of contiguous glass blocks forming a window unit, said window unit having a peripheral window surface secured within said channel; and a layer of glass fiber insulation disposed between said channel and said window unit.

10. The glass block window system of claim 9 wherein said channel comprises a sill channel, a header channel and first and second jamb channels, said sill channel, header channel and first and second jamb channel secured to respective ones of said sill member, first and second jamb members and header member.

11. The channel of claim 10 including a layer of mortar disposed between said sill channel and said window unit.

12. The glass block window system of claim 9 wherein each of said z-shaped anchors are welded to said hollow metal frame and screwed to said window frame.

* * * * *